US006191752B1

(12) United States Patent
Lester et al.

(10) Patent No.: US 6,191,752 B1
(45) Date of Patent: Feb. 20, 2001

(54) HF ANTENNAS FOR WIDEBAND SIGNALS

(75) Inventors: Howard Leroy Lester, Alplaus; John Erik Hershey, Ballston Lake, both of NY (US)

(73) Assignee: General Electric Company, Schenectady, NY (US)

( * ) Notice: Under 35 U.S.C. 154(b), the term of this patent shall be extended for 0 days.

(21) Appl. No.: 09/451,004

(22) Filed: Nov. 29, 1999

Related U.S. Application Data

(63) Continuation-in-part of application No. 09/100,162, filed on Jun. 18, 1998, now abandoned.

(51) Int. Cl.[7] ..... H01Q 21/00; H01Q 1/32
(52) U.S. Cl. ..... 343/867; 343/717
(58) Field of Search ..... 343/866, 867, 343/741, 742, 713, 717

(56) References Cited

U.S. PATENT DOCUMENTS

| | | | | |
|---|---|---|---|---|
| 1,484,049 | | 2/1924 | Zworykin | 343/717 |
| 2,005,519 | * | 6/1935 | Crosley, Jr. | 343/717 |
| 2,020,656 | * | 11/1935 | Renz | 343/717 |
| 2,055,830 | | 9/1936 | Vincent | 343/717 |
| 3,675,128 | | 7/1972 | Abele | 325/1 |
| 5,005,021 | | 4/1991 | Kato et al. | 343/717 |
| 5,588,005 | | 12/1996 | Ali et al. | 370/346 |

* cited by examiner

*Primary Examiner*—Tan Ho
(74) *Attorney, Agent, or Firm*—Marvin Snyder; Douglas E. Stoner

(57) ABSTRACT

High frequency (HF) antennas for wideband signals are used in the tracking of railcars. These are rugged antennas especially adapted to the hostile environment of a railcar. One antenna is in the form of a magnetic loop. Another generates an electric field produced by a plate mounted just below the railcar undercarriage with an optional dielectric slab situated between the plate and the undercarriage. The antennas need not be specified in terms of optimal parameters since the approach taken is to provide a generic antenna structure adapted to being fitted underneath the carriage of a railcar. This generic structure exhibits a mitigated Q and is capable of broadband tuning. This feature makes the antenna easier and less costly to produce in large quantities and facilitates use of a standard fitting mechanism and installation procedure.

10 Claims, 3 Drawing Sheets

HF ANTENNAS FOR WIDEBAND SIGNALS

CROSS REFERENCE TO RELATED INVENTIONS

This application is a continuation-in-part of application Ser. No. 09/100,162, filed Jun. 18, 1998 now abandoned.

BACKGROUND OF THE INVENTION

1. Field of the Invention

This invention generally relates to radio frequency (RF) antennas and, more particularly, to high frequency (HF) antennas for wideband signals used in the tracking of railcars.

2. Description of the Prior Art

U.S. Pat. No. 5,588,005 to Ali et al. and assigned to the instant assignee describes the tracking of assets, including goods and vehicles, using the Global Positioning System (GPS). While goods are an example of assets that need to be tracked, the containers, container trucks and railcars in which the goods are shipped are themselves assets which need to be tracked, not just because of the goods they carry, but also because they represent capital assets typically of a leasing company not associated with the carrier.

The mobile tracking unit used in the Ali et al. system includes a navigation set, such as a Global Positioning System (GPS) receiver or other suitable navigation set, responsive to navigation signals transmitted by a set of navigation stations which can be either space-based or earth-based. The navigation set is capable of providing data indicative of the vehicle location, based on the received navigation signals. In addition, the mobile tracking unit can include a suitable electromagnetic emitter for transmitting to a remote location the vehicle position data and other data acquired through use of sensing elements in the vehicle.

One of the options available for tracking railcars involves transmission of a wideband HF signal from the tracked railcar. The frequency of interest and the railcar environment make the problem of efficient antenna design especially difficult. Neither a whip antenna or large erect loop antenna is deemed a viable candidate as it would be expected to suffer environmental damage and/or exceed the template limits for the railcar which are set by the railcar industry in order that the railcar may traverse rail systems of appropriate gauge without ordinarily suffering or causing damage. As the antenna is a critical element of such communications system, what is needed is a suitable antenna which is especially adapted for use on a railcar.

A primary requirement for the antenna is that it be rugged. The railcar environment is notoriously hostile. Any antenna mounted on a railcar would be subject to vibration, shock, abrasion, high humidity, extreme dryness, heat, cold and vandalism.

BRIEF SUMMARY OF THE INVENTION

Two forms of antenna for the special and unaddressed application of fitting an HF antenna underneath the carriage of a railcar are provided. One antenna is a magnetic loop composed of rugged materials such as pipes or rods. The other is an electric field antenna which is an excited, ruggedly mounted plate located just below the undercarriage, with an optional dielectric slab between the plate and the undercarriage. Optimal parameters for an antenna fitted underneath the carriage of a railcar are a function of the specific railcar type and construction. Therefore, the antennas described herein are not specified in terms of optimal parameters; rather, the approach taken in the practice of the invention is to provide a generic antenna structure adapted to being mounted underneath the carriage of a railcar. This generic structure exhibits a mitigated Q and capability of broadband tuning. This makes it easier and less costly to produce the antenna in large quantities and facilitates use of a standard mounting mechanism and installation procedure.

DETAILED DESCRIPTION OF PREFERRED EMBODIMENTS OF THE INVENTION

Figure 1:
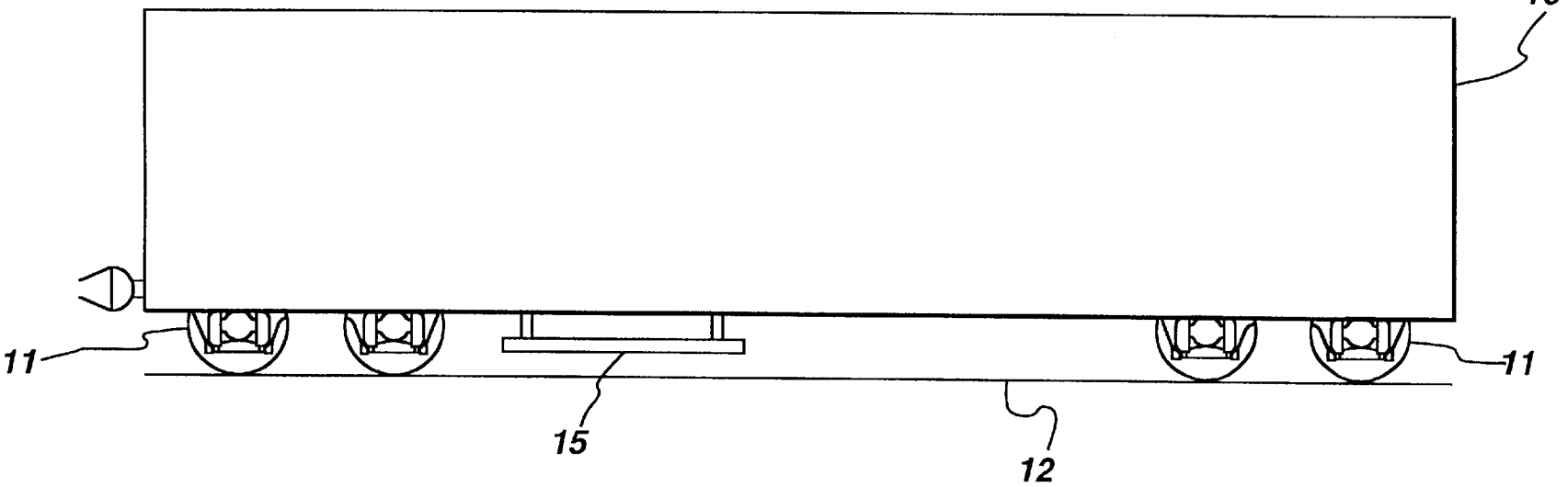
FIG. 1 is a side view of a railcar showing the mounting location for an antenna according to the invention.

FIG. 1 illustrates a railcar 10 having wheel trucks 11 rolling on a track or rail 12. This illustration is highly schematic. For example, each of wheel trucks 11 is typically a four-wheel truck as installed on most railcars currently in use in North America. Further, it will be understood that the structure of the railcar, while varying from type to type, has metal in the undercarriage and this metal is sufficient to complete the electrical circuit needed for the larger radiating loop.

The antenna according to the invention, whether of the magnetic field or electric field variant, is fitted underneath the carriage of railcar 10. In FIG. 1 this is shown by representation of a generic antenna 15 fitted toward one end of the railcar. This mounting of the antenna has several advantages. One advantage is that the antenna is generally protected. Since it is not attached to an end of the railcar, it is not exposed to damage due to coupling or expose to easy sabotage, nor does it interfere with any manual coupling/decoupling operations with the railcar. Another advantage, described in more detail below, is that the antenna can be incorporated into the railcar undercarriage structure, making it extremely rugged and, at the same time, quite inexpensive to manufacture.

Figure 2:
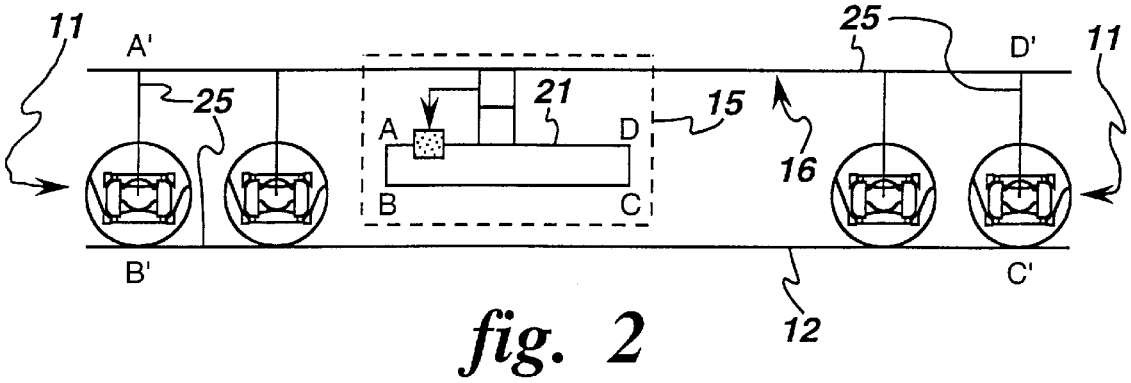
FIG. 2 is a side view of a magnetic loop antenna according to a first preferred embodiment of the invention.

The magnetic antenna is comprised of a first, smaller loop and a second, larger loop, as shown in FIG. 2. The first loop 21 of the antenna is defined by the rectangle ABCDA and is formed by a solid and rugged conductor such as a pipe or rod. The loop is mounted vertically so that a line passing through its center and perpendicular to its plane will be horizontal and at right angles to the length of the railcar. Antenna loop ABCDA serves to excite a pair of larger radiating loops 25 created by the undercarriage, rails, and wheels 13 of wheel trucks 11. One of these two larger loops is shown in FIG. 2 and labeled A'B'C'D'A'. The second of these two larger loops is identical to the one shown in FIG. 2, but is on the opposite side of the railcar and involves the other rail of the track and the wheels in rolling contact with that other rail. Each of the two larger loops extends beyond the bounds of the first loop.

Figure 3:
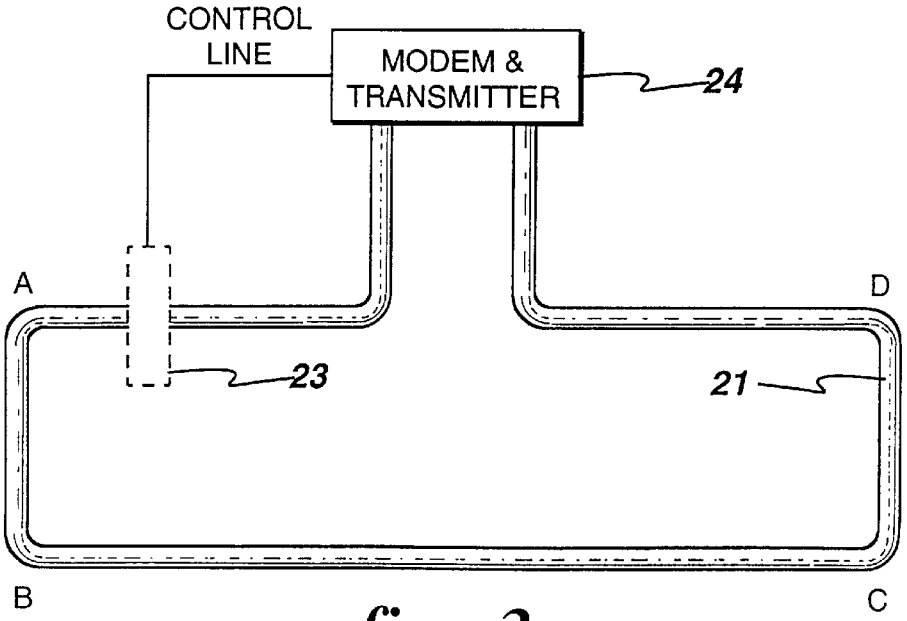
FIG. 3 is an enlarged view of the magnetic loop antenna according to a first preferred embodiment of the invention.

The RF coupling to the first loop ABCDA of the antenna may be either shunt or series. In the preferred embodiment shown in FIG. 3, a variable impedance 23 is inserted in sections of pipe or rod 21. This variable impedance 23 is capacitive and is controllable by a modem and transmitter 24. The impedance is set according to stored table values corresponding to the particular transmission channel in use.

The dimensions of larger loops A'B'C'D'A' (only one of which is shown) are determined by the template of the particular railcar. The dimensions of the smaller loop ABCDA are not critical. In the preferred embodiment, the height, i.e., A–B and C–D, is 0.3 meters and length, i.e., A–D and B–C, is 8 meters. The smaller loop may comprise one loop or a plurality of loops in series; i.e., the number of turns can be equal to or greater than one. The number of turns may be manually selected by a switch or, if desired, electrically selected, depending on the specific application.

Figure 4:
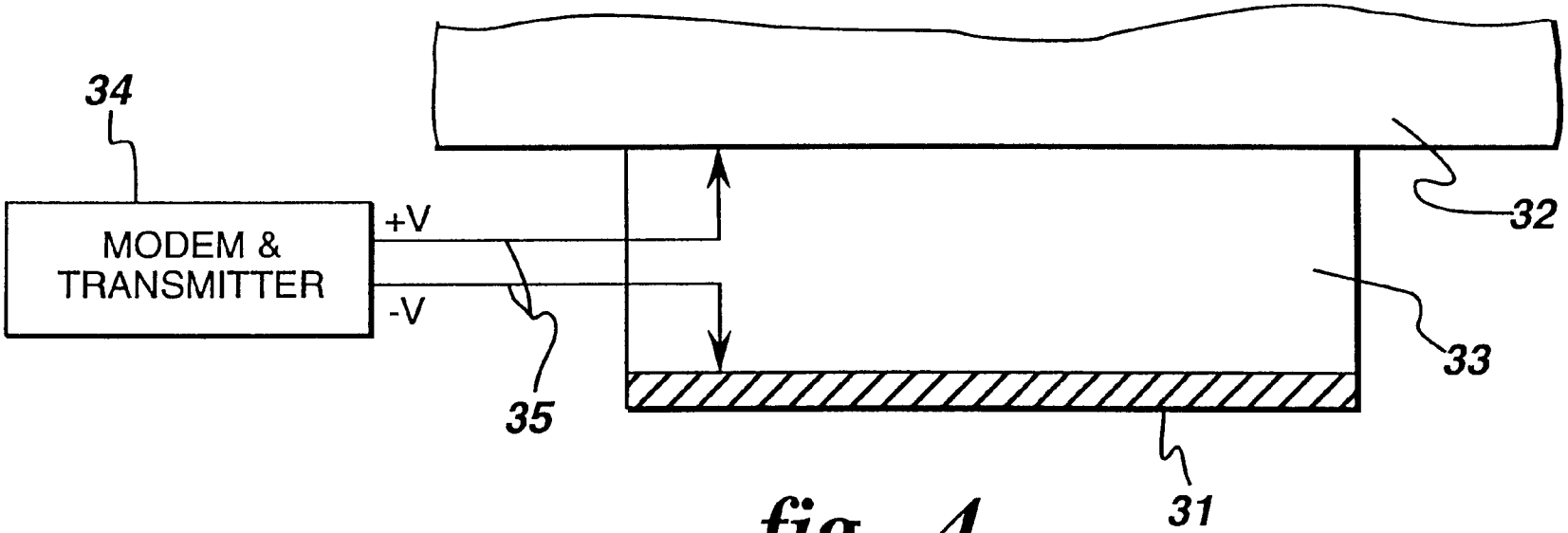
FIG. 4 is a schematic diagram showing an electric field antenna according to a second preferred embodiment of the invention.

As shown in FIG. 4, an electric field antenna is comprised of a slot antenna defined as a conducting plate 31 suspended below the bottom of the railcar frame or undercarriage 32. Plate 31 may be parallel to the ground or slightly inclined thereto. Further, plate 31 may be fixed or its inclination may be adjustable, typically manually. A dielectric slab 33 extending over at least a major portion of the area of plate 31 may be situated between plate 31 and railcar undercarriage 32 so as to serve two functions. First, slab 33 can be used as an antenna load matching aid. Second, slab 33 serves to make the antenna more rugged. For this reason, the dielectric of slab 33 is preferably a high impact plastic.

Plate 31 and railcar frame 32 are oppositely excited by RF voltage from a modem and transmitter 34 electrically coupled thereto through an antenna feed 35 to load the plate, as one side of the antenna slot, with the other side of the antenna slot being the undercarriage of the railcar. The rails form a natural ground plane and, provided there is sufficient coupling of the HF signal through the truck bearings, the radiation should be sufficiently enhanced. Placing the center of plate 31 nearer to one end of the railcar extends the usable bandwidth of the antenna as the wave can propagate to the end of the car, through the truck, and back down the rail. The plate antenna is of sufficiently low Q that the antenna will be broadly tuned.

While only certain preferred features of the invention have been illustrated and described, many modifications and changes will occur to those skilled in the art. It is, therefore, to be understood that the appended claims are intended to cover all such modifications and changes as fall within the true spirit of the invention.

Having thus described our invention, what we claim as new and desire to secure by Letters Patent is:

1. An HF (high frequency) antenna for mounting under a railcar adapted for traveling on rails, comprising:

a first loop formed by a solid conductor fitted toward one end of an undercarriage of the railcar, said first loop being mounted vertically so that a line perpendicular to a plane defined by said loop is horizontal and at right angles to the length of the railcar; and a second loop larger than the first loop and defined by the undercarriage of the railcar, wheel trucks of the railcar, a rail, and wheels of said wheel trucks in contact with said rail, the first loop being operable to excite the second loop.

2. The HF antenna recited in claim 1 and further comprising a variable impedance in series with the first loop, the variable impedance being adapted to be set by a modem and transmitter according to a transmission channel in use.

3. The HF antenna recited in claim 1 including a third loop larger than the first loop and defined by the undercarriage of the railcar, wheel trucks of the railcar, a second rail, and wheels of said wheel trucks in contact with said second rail, said third loop being identical in configuration to said second loop.

4. The HF antenna recited in claim 3 wherein the first loop comproses a plurality of turns.

5. The HF antenna recited in claim 4 wherein a number of the plurality of turns is selectable.

6. The HF antenna recited in claim 1 wherein the first loop comprises a plurality of turns.

7. The HF antenna recited in claim 6 wherein a number of the plurality of turns is selectable.

8. The HF antenna recited in claim 1 wherein the second loop extends beyond the bounds of the first loop.

9. An HF (high frequency) antenna for mounting under a railcar comprising:

a plate formed by a solid conductor fitted toward one end of an undercarriage of the railcar;

a dielectric slab interposed between the railcar undercarriage and the plate for providing antenna load matching, said slab extending over at least a major portion of the area of said plate; and an antenna feed connected to the plate and the railcar undercarriage, the plate and the railcar undercarriage being adapted to be oppositely excited by an RF voltage.

10. The HF antenna recited in claim 9 wherein the plate is inclined to the ground.

* * * * *